United States Patent [19]

Cacicedo

[11] Patent Number: 4,602,764

[45] Date of Patent: Jul. 29, 1986

[54] BARRIER APPARATUS

[76] Inventor: Paulino A. Cacicedo, 5 Tisbury Carriage Dr., Scotch Plains, N.J. 07076

[21] Appl. No.: 750,461

[22] Filed: Jul. 1, 1985

[51] Int. Cl.[4] ..... E04H 17/00

[52] U.S. Cl. ..... 256/11; 256/2

[58] Field of Search ..... 256/11, 12, 3, 4, 2

[56] References Cited

U.S. PATENT DOCUMENTS

| | | | |
|---|---|---|---|
| 282,895 | 8/1883 | Hotchkiss | 256/11 |
| 589,943 | 9/1897 | Graham | 256/11 |
| 677,396 | 7/1901 | Brown | 256/11 |
| 1,233,230 | 7/1917 | Hassett | 256/12 |
| 1,596,621 | 8/1926 | Omlor | 256/11 |
| 1,698,577 | 1/1929 | Baum | 256/11 |

*Primary Examiner*—Andrew V. Kundrat

*Attorney, Agent, or Firm*—R. Gale Rhodes, Jr.

[57] ABSTRACT

Barrier apparatus including a plurality of generally longitudinally extending barrier members, such as a plurality of strands of barbed wire or a plurality of strands of razor ribbon, and support means for supporting the barrier members in generally cylindrical and circularly spaced apart configuration.

3 Claims, 6 Drawing Figures

BARRIER APPARATUS

BACKGROUND OF THE INVENTION

This invention relates generally to improved barrier apparatus and more particularly to improved barrier apparatus for providing a deterrent to ingress into and/or egress from a secured area.

Many barrier apparatus are known to the prior art for providing a deterrent to ingress into and/or egress from a secured area. The most common is the well known barbed wire fence comprised of a plurality of strands of vertically spaced barbed wire supported by a plurality of horizontally spaced posts. Another well-known prior art barrier apparatus is the mesh wire fence also typically supported by a plurality of horizontally spaced posts. Also known to the prior art are barrier apparatus of the aforementioned type which may be topped by a plurality of strands of barbed wire inclined at an angle towards the outside of the secured area and, in some instances, a plurality of strands of barbed wire inclined at an angle towards the inside of the secured area; such angularly oriented strands of barbed wire for preventing a human from climbing the security fence and then climbing upwardly over the top of the security fence. However, it has been found that a human is able to climb the security fence and to climb up and over the angularly inclined strands of barbed wire due, primarily, to the fact that no deterrent to ingress or egress is provided at the top of the security fence.

Accordingly, there exists a need in the barrier apparatus art for improved barrier apparatus providing an improved all around deterrent from both sides and thus an improved deterrent to both ingress into and egress from a secured area.

SUMMARY OF THE INVENTION

The primary object of the present invention is to provide improved barrier apparatus satisfying the aforementioned need in the barrier apparatus art.

Barrier apparatus satisfying such need and embodying the present invention may include a plurality of generally longitudinally extending barrier members, such as a plurality of strands of barbed wire or a plurality of strands of razor ribbon, and support means for supporting the barrier members in generally cylindrical and circularly spaced apart configuration.

DESCRIPTION OF THE PREFERRED EMBODIMENTS

Figure 1:
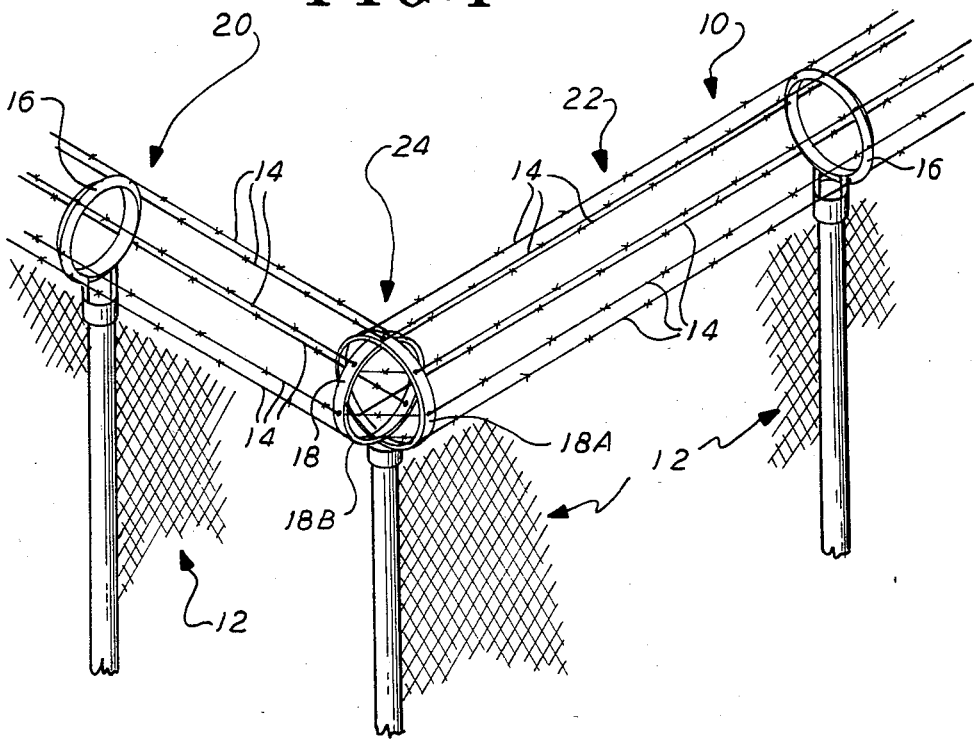
FIG. 1 is a diagrammatical illustration of barrier apparatus embodying the present invention and shown topping a free standing security fence.

Referring now to FIG. 1, there is shown barrier apparatus embodying the present invention and indicated by general numerical designation 10 shown topping a security fence indicated by general numerical designation 12. The barrier apparatus 10 may comprise a plurality of generally longitudinally extending strands of barbed wire 14 and a plurality of support members 16—16 and 18 for supporting the plurality of strands of barbed wire 14 in generally cylindrical and circularly spaced apart configuration as shown.

Annular support members 16—16 are for supporting generally linear sections indicated by general numerical designations 20 and 22 of barrier apparatus 10 and the generally angular support member 18 is for being positioned at and for supporting an intermediate angular section indicated by general numerical designation 24 of the barrier apparatus 10.

Figure 2:
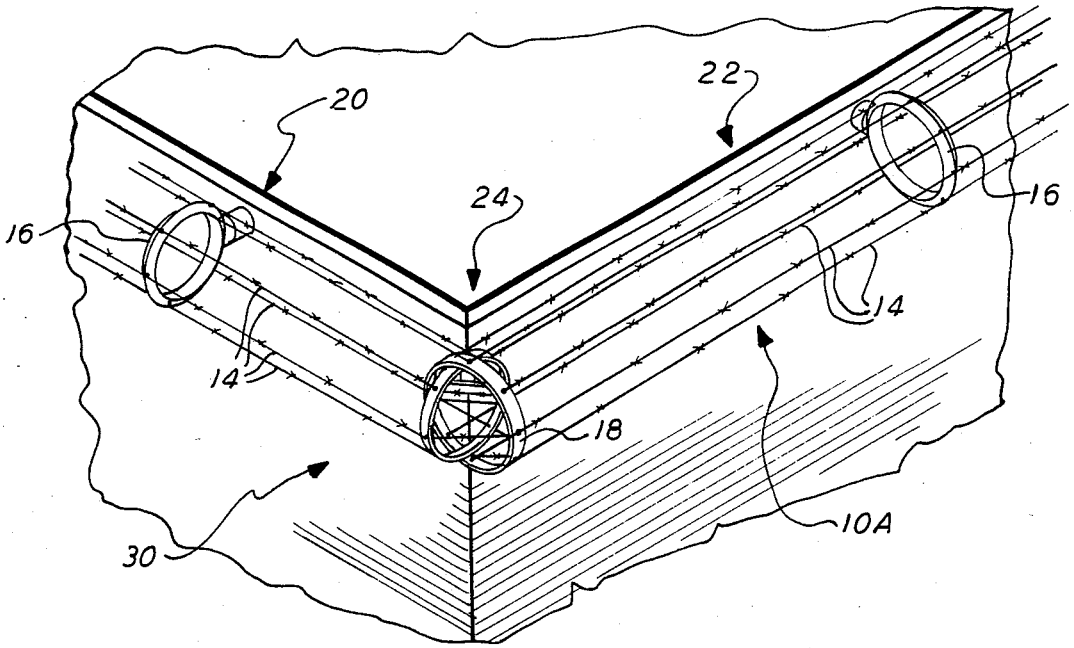
FIG. 2 is an alternate embodiment of barrier apparatus embodying the present invention and shown mounted horizontally to the side of a building.

Referring now to FIG. 2, there is shown an alternate embodiment of barrier apparatus embodying the present invention and indicated by general numerical designation 10A. Barrier apparatus 10A is substantially identical to above-described barrier apparatus 10 shown in FIG. 2; accordingly, the structure embodying barrier apparatus 10A has been given the same numerical designations as the corresponding structure of barrier apparatus 10. As shown, barrier apparatus 10A is mounted horizontally to the side of a flat topped building indicated by general numerical designation 30.

Figure 3:
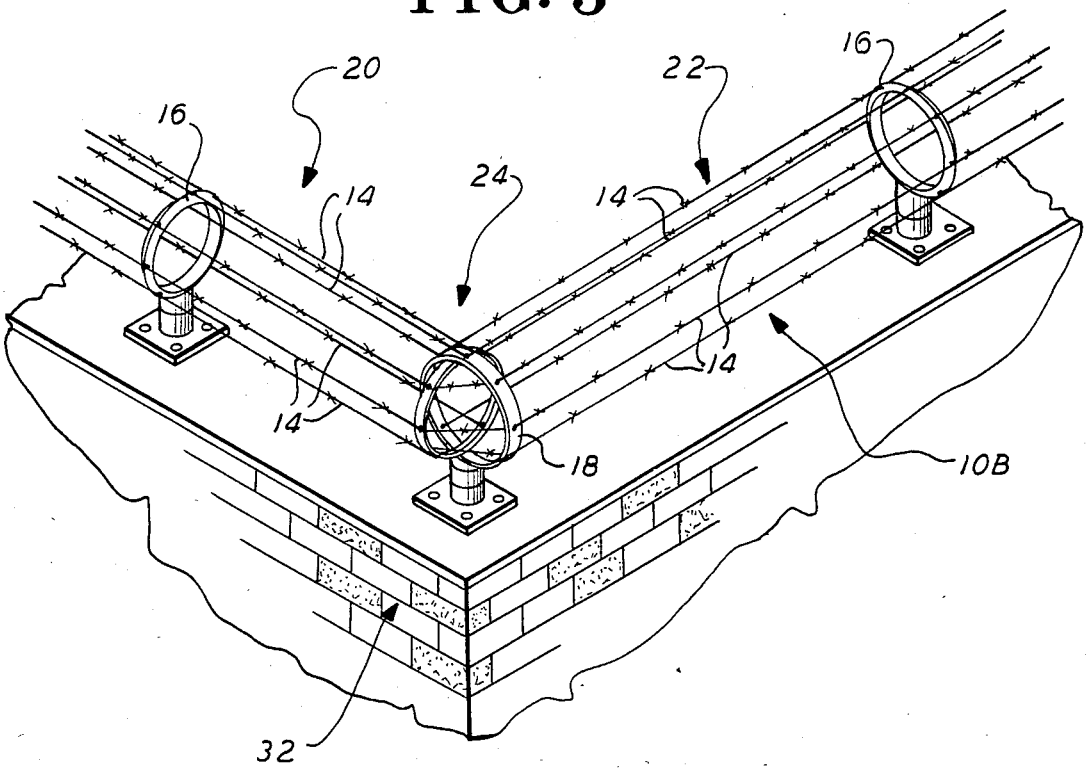
FIG. 3 is another alternate embodiment of barrier apparatus embodying the present invention and shown mounted horizontally to the top of a parapet.

A still further alternate embodiment of the barrier apparatus of the present invention is shown in FIG. 3 and which is identified by general numerical designation 10B; since barrier apparatus 10B is substantially identical to previously described barrier apparatus 10, the structure comprising barrier apparatus 10B is also given the same numerical designations as the structure of barrier apparatus 10. Barrier apparatus 10B is shown mounted to the top of a solid wall indicated by general numerical designation 32.

Referring generally to FIGS. 1–3, it will be noted that barrier apparatus 10, 10A and 10B provides deterrent to ingress into and/or egress from a secured area by providing an all around deterrent from both sides of the barrier apparatus. Further, it will be noted that the generally cylindrical and circularly spaced apart configuration of the barrier apparatus of the present invention provides an improved deterrent to prevent a human from climbing up and over the barrier apparatus because in all directions, around 360°, such human would be required to grasp and climb over the cylindrical and circularly oriented strands of barbed wire 14.

It will be understood by those skilled in the art that the strands of barbed wire 14 may be substituted, in accordance with the further teachings of the present invention, by a plurality of strands of razor ribbon.

Figure 4:
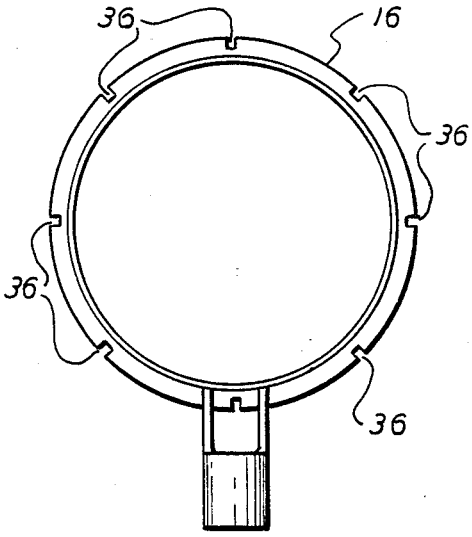
FIG. 4 is a front elevational view of support means embodying the present invention and for supporting a generally linear section of barrier apparatus embodying the present invention.
Figure 5:
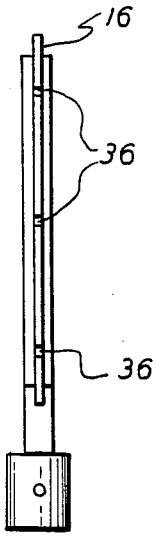
FIG. 5 is a side view of the support member of FIG. 4.

Referring now to FIGS. 4 and 5, there is shown in detail a support member 16 for being oriented transverse to and for supporting linear sections of barrier apparatus embodying the present invention. As will be noted from FIGS. 4 and 5, support member 16 may be of generally annular shape and provided at its periphery or peripheral portion with a plurality of annularly or circularly arranged indentations or grooves 36 for receiving the plurality of strands of barbed wire 14 (FIGS. 1–3).

Figure 6:
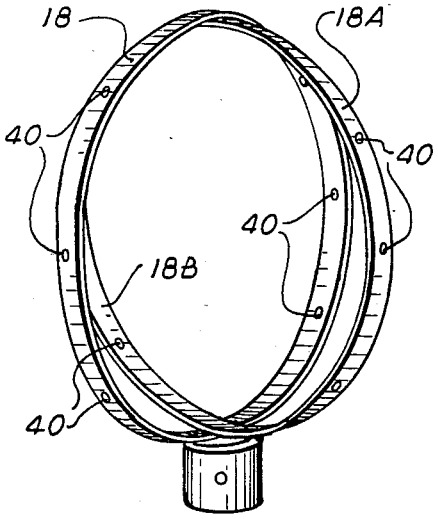
FIG. 6 is a perspective view of an angular support embodying the present invention and for being positioned at an angular section of barrier apparatus embodying the present invention which angular section is intermediate linear sections of barrier apparatus embodying the present invention.

Shown in FIG. 6 is detailed structure of an angular support 18 which, as shown, may comprise two interconnected generally circular support members 18A and 18B. As shown in FIG. 1, circular support member 18A is for being oriented generally transverse to linear section 22 of barrier apparatus 10 and generally circular support member 18B is for being oriented generally transverse with respect to linear section 20 of barrier apparatus 10. As will be noted by reference to FIG. 6, generally circular support members 18A and 18B are provided with a plurality of circularly oriented holes or apertures 40 for having extended therethrough the plurality of strands of barbed wire 14 (FIGS. 1–3) and for orienting the plurality of strands of barbed wire 14 in the abovenoted generally cylindrical and circularly spaced apart configuration.

It will be understood by those skilled in the art that many variations and modifications may be made in the present invention without departing from the spirit and the scope thereof.

What is claimed is:

1. Barrier apparatus, comprising:

a plurality of generally longitudinally extending barrier members including first and second generally linear sections and an intermediate angular section; and a plurality of generally annular support members for being spaced apart predetermined distances and for supporting said barrier members in generally cylindrical and circularly spaced apart configuration, said support members including transverse portions oriented generally transverse to said barrier members and said support members including generally circular peripheral portions provided with barrier member engaging portions for securing said barrier members to said support members in said configuration, and wherein said support members include an angular support positioned at said intermediate angular section, said angular support comprising at least two interconnected generally circular support members one oriented generally transverse to said first generally linear section and the other oriented generally transverse to said second generally linear section.

2. Barrier apparatus according to claim 1 wherein said barrier members comprise a plurality of strands of barbed wire.

3. Barrier apparatus according to claim 1 wherein said barrier members comprise a plurality of strands of razor ribbon.

* * * * *